US010880654B1

(12) United States Patent
Solis et al.

(10) Patent No.: US 10,880,654 B1
(45) Date of Patent: Dec. 29, 2020

(54) SYSTEMS AND METHODS FOR EXPANDING SENSATION USING TEMPERATURE VARIATIONS

(71) Applicant: Soniphi LLC, Incline Village, NV (US)

(72) Inventors: Deric Solis, Santa Rosa, CA (US); Wayne J. Powell, Centennial, CO (US); Matthew Sanderson, Incline Village, NV (US); James McClanahan, Greenwood Village, CO (US)

(73) Assignee: Soniphi LLC, Incline Village, NV (US)

( * ) Notice: Subject to any disclaimer, the term of this patent is extended or adjusted under 35 U.S.C. 154(b) by 0 days.

(21) Appl. No.: 16/540,958

(22) Filed: Aug. 14, 2019

(51) Int. Cl.
*H04R 23/02* (2006.01)
*H04R 1/10* (2006.01)

(52) U.S. Cl.
CPC ..... *H04R 23/02* (2013.01); *H04R 1/1016* (2013.01); *H04R 1/1091* (2013.01)

(58) Field of Classification Search
CPC ..... H04R 23/02; H04R 1/1016; H04R 1/1091
See application file for complete search history.

(56) References Cited

U.S. PATENT DOCUMENTS

| | | | | |
|---|---|---|---|---|
| 10,219,087 | B2 | 2/2019 | Dalhoff | |
| 10,256,529 | B2 | 4/2019 | Yang et al. | |
| 2017/0274219 | A1 | 9/2017 | Ernst et al. | |
| 2018/0324516 | A1 | 11/2018 | Campbell et al. | |
| 2018/0333590 | A1* | 11/2018 | Millard | A61N 5/0618 |
| 2019/0053764 | A1 | 2/2019 | LeBoeuf et al. | |
| 2019/0158961 | A1 | 5/2019 | Puria et al. | |

FOREIGN PATENT DOCUMENTS

| | | |
|---|---|---|
| IN | 201941007751 | 4/2019 |
| WO | 2018018085 | 1/2018 |

* cited by examiner

*Primary Examiner* — Mark Fischer
(74) *Attorney, Agent, or Firm* — Fish IP Law, LLP

(57) ABSTRACT

Apparatus and methods for creating a sensation in which a sound driver emits sound waves according to incoming information, and one or more light emitters emit light waves with varying patterns according to amplitude and frequency changes in the incoming information. Preferably, only low frequency signals (below 50 Hz) are used to produce the pattern of the light waves, which are directed directly towards the tympanic membrane without any artificial barrier. Emitted light preferably reaches the inner ear region substantially simultaneously with emitted sound waves. A second light emitter can be used to emit light waves that are complementary to, and preferably between 175 and 185 degrees out of phase with, the light waves from the first light emitter, to produce scalar waves.

11 Claims, 3 Drawing Sheets

SYSTEMS AND METHODS FOR EXPANDING SENSATION USING TEMPERATURE VARIATIONS

FIELD OF THE INVENTION

The field of the invention is expanding sensation.

BACKGROUND

The following description includes information that may be useful in understanding the present invention. It is not an admission that any of the information provided herein is prior art or relevant to the presently claimed invention, or that any publication specifically or implicitly referenced is prior art.

Hearing sensation is created by a series of events that convey information in the form sound waves to the auditory cortex. Sound waves travel to the eardrums (i.e., tympanic membranes) through the ear canals, and cause the eardrums to vibrate. The vibrations move through the fluid in the inner ear (i.e., cochlea) and cause auditory hair cells in the cochlea to move. The auditory hair cells detect the movement and change it into the chemical signals (e.g., neurotransmitters) for the auditory nerves to receive. The auditory nerves then send the information as nerve impulses (i.e., electrical signals) to the auditory cortices of the brain, where the information is interpreted as sound.

As the organ of hearing, the ear is not as capable of sensing light as the eye. However, that does not preclude light having an impact on the cells of the ear. One possible impact is that certain lights can trigger photochemical reactions on a cellular level. Similar to skin cells that can respond to UV radiation by synthesizing melanin, certain photochemical reactions can be initiated in cells in the ear due to irradiation. Another possible impact is the temperature increase caused by the light radiation, especially by infra red radiation. For example, cellular metabolism (e.g., protein synthesis) tends to increase with higher temperatures and decrease when temperature falls.

Previous work has used light to irradiate the ear in hopes of bringing about certain photochemical reactions that have a protective effect on the cells in the ear. United States Patent Application Publication No. US20170274219A1 (Ernst et al.) teaches an irradiation apparatus for the prophylaxis of hearing impairment having a photon emitter for irradiating the inner ear. Indian patent application publication IN201941007751A (Thirumaaran et al.) teaches a device for introducing optical radiation into an ear. PCT Publication No. WO2018018085A1 (Palmer et al.) teaches a hearing loss alleviating device using electromagnetic radiation to treat different parts of the inner ear. U.S. patent Ser. No. 10/219,087B2 (Dalhoff et al.) teaches a hearing aid having a supply module that blocks the ear canal and comprises a light emitter. United States Patent Application Publication No. US20190053764A1 (LeBoeuf et al.) teaches a headset having two sensor modules directing electromagnetic radiation at different target regions of the ear.

In all these references mentioned above, the emitted light does not match any characteristics of an incoming sound. United States Patent Application Publication No. US 2019/0158961 A1 to Puria et al. teaches a hearing system in which a transducer assembly placed on the eardrum receives light signals and vibrate the eardrum to produce a sound output. However, the light is blocked by the output transducer assembly attached to the eardrum, and would not be able to reach the eardrum, the middle ear, or the inner ear, and cause a sensation either by increasing the temperature of the cells in the ear or by initiating a photochemical reaction thereof.

Thus, there is still a need for a device or method in which a sensation is created by directing sound waves and light waves with matching patterns directly onto the tympanic membrane.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

SUMMARY OF THE INVENTION

The inventive subject matter provides apparatus, systems and methods in which sound waves and corresponding patterned light waves create a sensation in one or both ears of a user.

One aspect of the inventive subject matter is a wearable apparatus for providing a sensation to an ear of a user. The wearable apparatus comprises a sound driver and at least one light emitter emitting patterned light waves, wherein at least some of the light waves pass through the tympanic membrane to the inner ear region. The sound driver is configured to emit sound waves in correspondence to incoming information. Preferably, the incoming information is a digital recording that can be played on a computer or mobile phone. The light emitter can be configured to emit light waves of any wavelength, preferably using a red laser with wavelengths between 645 nm and 655 nm.

In preferred embodiments, the pattern of light waves comprises pulses with varying amplitudes and frequencies, which correspond to at least one of the varying amplitudes and the varying frequencies of the incoming information. Also in preferred embodiments, the pattern comprises pulses having a frequency between 0.1 Hz and 50 Hz. In especially preferred embodiments, the frequency of the pattern is between 16 Hz and 32 Hz. Some embodiments further comprise a low band pass filter that passes low frequency signals of the incoming information, such that only low frequency signals are used to produce the pattern of light waves. For example, a circuitry can be used to generate a pattern comprising pulses with varying frequencies below 50 Hz, or more preferably, below 32 Hz.

In other aspects of preferred embodiments, the sound driver and light emitter are further configured such that the emitted light reaches the inner ear region substantially simultaneously with emitted sound waves. For example, emitted light waves reach the inner ear region between within 0.1 msec before or after the emitted sound waves reach the inner ear region. For another example, emitted light waves reach the inner ear region within 0.5 msec before or after the emitted sound waves reach the inner ear region.

It is contemplated that there is no actuator attached to the tympanic membrane, so that the emitted light reaches the tympanic membrane without any artificial barrier. It is further contemplated at least 50% of the emitted light reaches the tympanic membrane. In preferred embodiments, at least 75% of the emitted light reaches the tympanic membrane. In especially preferred embodiments, at least 90% of the emitted light reaches the tympanic membrane.

It is further contemplated neither the sound driver nor the light emitter blocks more than 50% of ambient audible sound from passing through the ear canal to the tympanic membrane. In preferred embodiments, at least 75% of the ambient audible sound passes through the ear canal and reaches the tympanic membrane. In especially preferred embodiments, at least 90% of the ambient audible sound passes through the ear canal and reaches the tympanic membrane.

Some embodiments further comprise a second light emitter configured to emit light waves that are complementary to the light waves from the first light emitter. In especially preferred embodiments, the light waves emitted from the second light emitter are out of phase with light waves emitted from the first light emitter. The contemplated phase offset is from 85 to 190 degrees. In preferred embodiments, the second light emitter is configured to emit light waves that are 180 degrees out of phase with the light waves from the first light emitter to create the cancelling effect causing the scalar waves. Preferably, the second light emitter emits light waves into the same ear canal as does the first light emitter, so that the second light waves cancel out the first light waves to produce scalar waves. It is also contemplated that the first and second light emitter emits light waves into different ear canals.

The inventive subject matter also provides methods for enhancing a user's sensation of auditory information. The contemplated methods use a sound driver to emit sound waves according to incoming information and one or more light emitters to emit light waves with patterns according to at least one of amplitude and frequency changes in the incoming information. The sound and light waves are directed toward the same or different parts of the body. Contemplated body parts include ear canal, eyes, or other parts of the body having nerve endings. For example, the light waves can be directed toward the left ear canal only, the right ear canal only, the left eye only, the right eye only, or any combination of the above. Similarly, the sound waves can be directed to the left ear canal, the right ear canal, or both. In preferred embodiments, when the patterned light waves are directed to an ear, they are directly onto the tympanic membrane of the ear.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
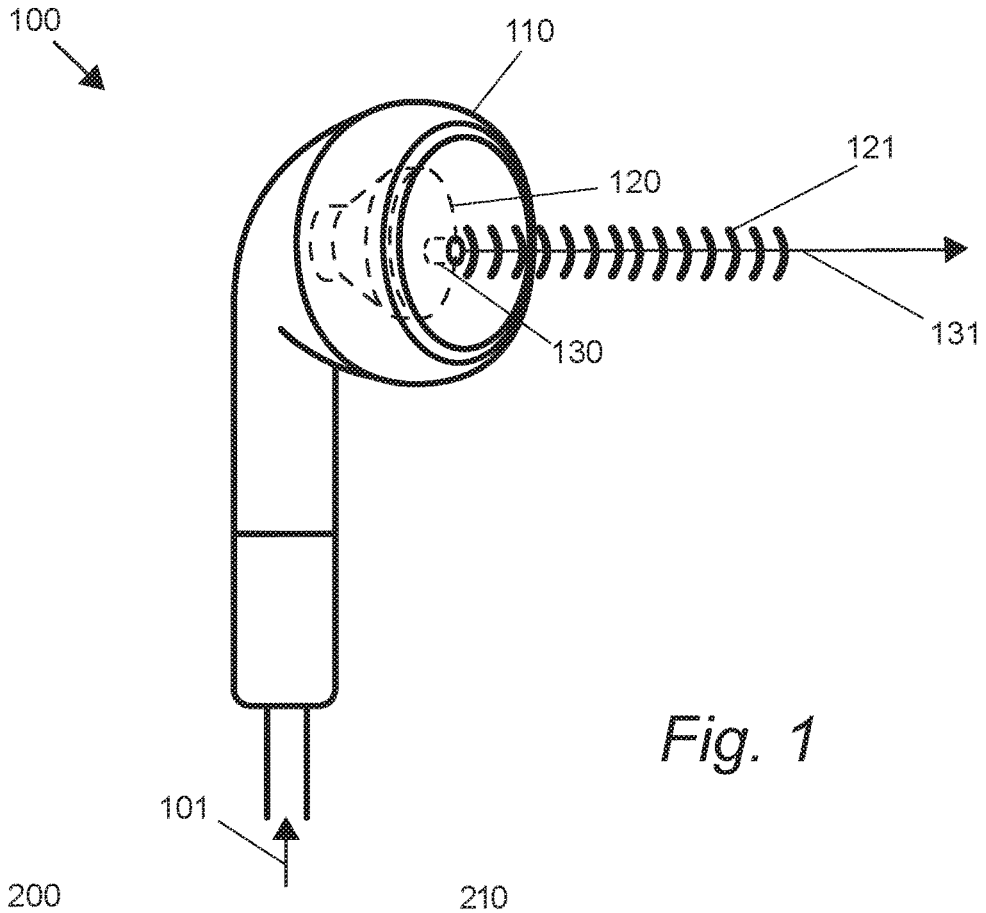
FIG. 1 shows an embodiment of a wearable apparatus having one light emitter.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In FIG. 1, a wearable apparatus 100 has a body 110, a sound driver 120, and a light emitter 130. The body 110 is shaped and sized to fit a person's ear. The body 110 can take the shape of an ear phone, an ear bud, or a hearing aid, etc. The sound driver 120 is configured to emit sound waves 121 in correspondence to incoming information 101. The incoming information 101 can be generated from a digital recording that can be played on a computer or mobile device (e.g., MP3 player, mobile phone, etc.), or information that is generated by a microphone.

The light emitter 130 can be configured to emit light waves 131 of any wavelength, but preferably a red laser, and more preferably with wavelength between 645 nm and 655 nm. The light emitter 130 can be configured to emit light waves 131 having a pattern, e.g., pulses. The pulsing frequency can be a fixed value, preferably between 0.1 Hz and 50 Hz, or varying values. The amplitude of the emitted light 131 can be a fixed value or varying values (e.g., a sine wave). The light emitter 130 can also be configured to emit light waves 131 with varying amplitudes and frequencies, which correspond to at least one of the varying amplitudes and the varying frequencies of the incoming information 101. In preferred embodiments, a low band pass filter is used to pass only low frequency signals of the incoming information 101, such that only the low frequency signals are used to produce the pattern of the light waves 131. The low frequencies used are preferably between 0.1 Hz and 50 Hz, and more preferably between 16 Hz and 32 Hz.

Figure 2:
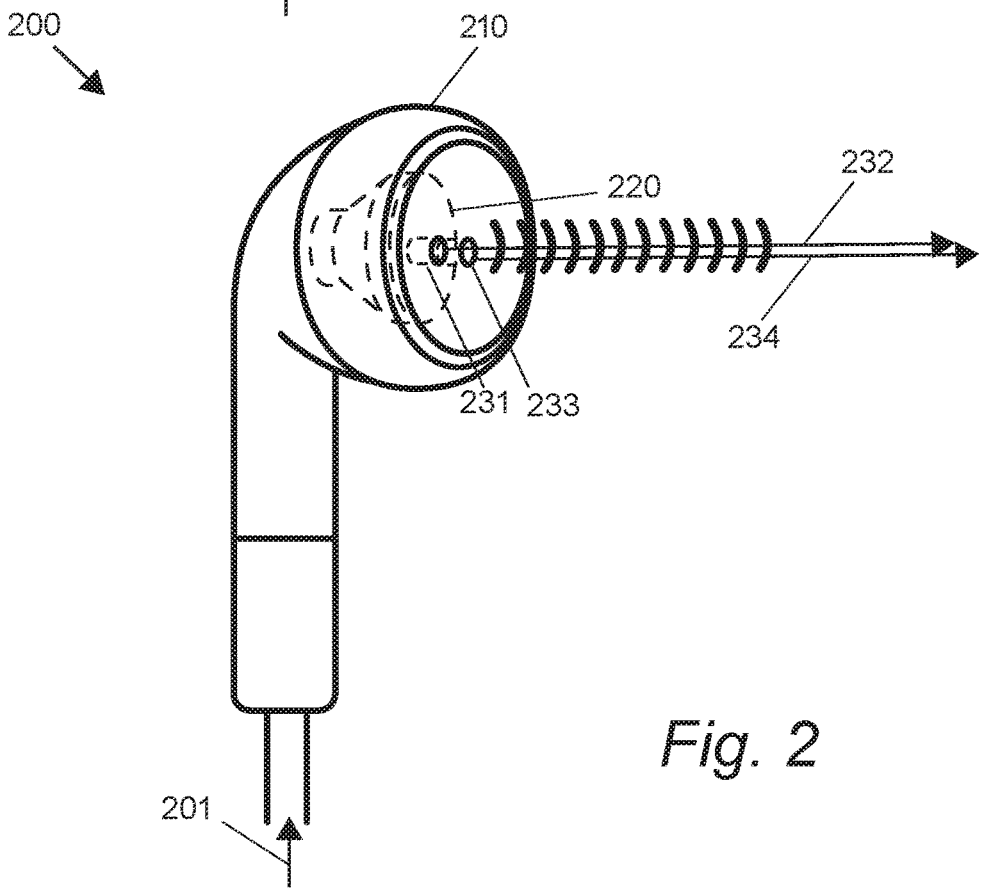
FIG. 2 shows another embodiment of a wearable apparatus having two light emitters.

In FIG. 2, a wearable apparatus 200 has a body 210, a sound driver 220, and two light emitters, a first light emitter 231, and a second light emitter 232. Preferably, the second light emitter 233 is configured to emit light waves 234 that are complementary to the light waves 232 from the first light emitter 231. In especially preferred embodiments, the second light emitter 233 is configured to emit light waves 234 that combine with the light waves 232 from the first light emitter 231 to produce scalar waves. For example, the light waves 234 emitted from the second light emitter 233 are 180 degrees out of phase with light waves 232 emitted from the first light emitter 231. Background information about "scalar waves" is described in U.S. patent Ser. No. 10/022,517B2 and U.S. Pat. No. 9,917,654B2, and United States agent Application No. US20190109376A1 and US20180126118A1, all of which are incorporated herein by reference.

The light emitters 231 and 233 can be configured to emit light waves of any wavelength, and preferably with wavelength(s) between 645 nm and 655 nm. Emitters are preferably red diode lasers. The light emitters 231 and 233 can also be configured to emit light waves with varying amplitudes and frequencies, which correspond to at least one of the varying amplitudes and the varying frequencies of the incoming information 201. In preferred embodiments, the pattern comprises pulses having one or more frequencies between 0.1 Hz and 50 Hz. In especially preferred embodiments, the one or more frequencies of the pulsing pattern are between 16 Hz and 32 Hz.

Figure 3:
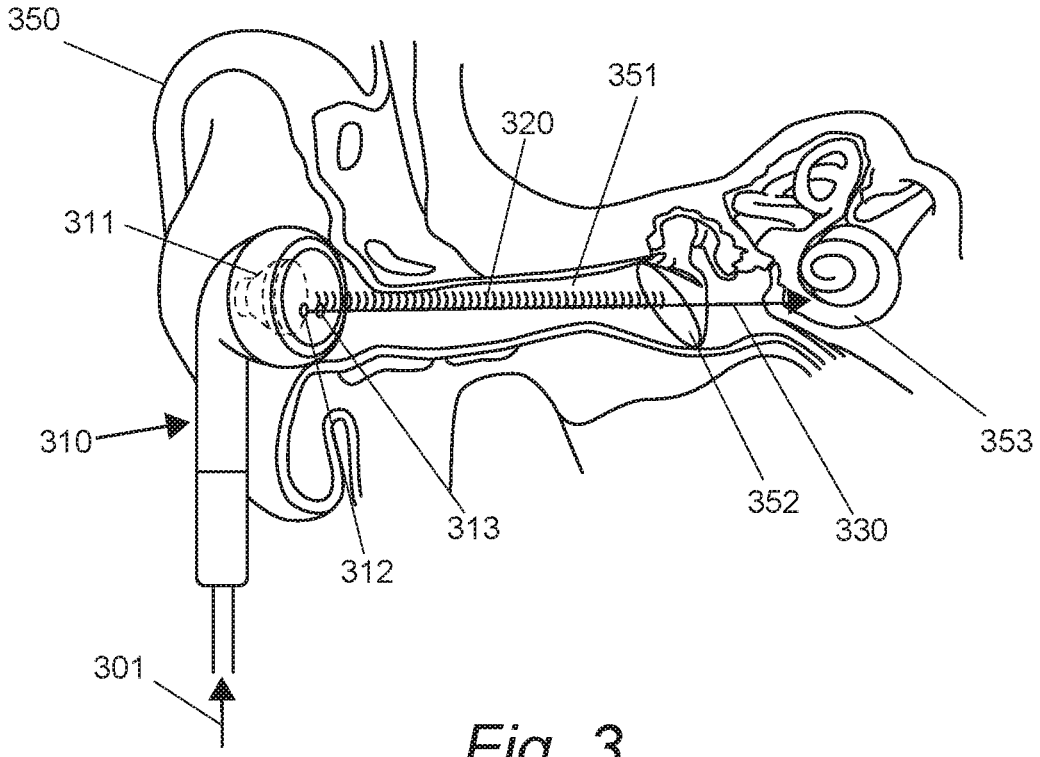
FIG. 3 shows the embodiment of a wearable apparatus in FIG. 2 in an ear of a user.

FIG. 3 shows a wearable apparatus 310 in an ear 350 of a user. The wearable apparatus comprises a sound driver 311, a first light emitter 312, and a second light emitter 313. The sound driver 311 is configured to emit sound waves 320 that travel along the ear canal 351 and reach the tympanic membrane 352. Preferably, the sound waves 320 are in correspondence to incoming information 301, at least in terms of frequency or amplitude.

The light emitters 312 and 313 produce light waves 330 that travel along the ear canal 351 and reach the tympanic membrane 352, without any artificial barrier. In some embodiments, at least 50% of the emitted light waves 330 reach the tympanic membrane 352. In preferred embodiments, at least 75% of the emitted light waves 330 reach the tympanic membrane 352. In especially preferred embodiments, at least 90% of the emitted light waves 330 reach the tympanic membrane 352. It is contemplated that the light waves 330 increase the temperature of the tympanic membrane 352. In preferred embodiments, the temperature of the tympanic membrane 352 is transiently increased by at least 0.1° C. The preferred light waves 330 have a pattern that corresponds to the incoming information 301 at least in terms of frequency or amplitude, and the temperature increase in the tympanic membrane 352 also corresponds to the incoming information 301.

It is contemplated that at least some of the light waves 330 pass through the tympanic membrane 352 and reach the inner ear region 353. In some embodiments, at least 25% of the emitted light waves 330 reach the inner ear region 353. In preferred embodiments, at least 35% of the emitted light waves 330 reach the inner ear region 353. In especially preferred embodiments, at least 50% of the emitted light waves 330 reach the inner ear region 353. It is contemplated that the light waves 330 increases the temperature of the inner ear region 353. In preferred embodiments, the temperature of the ear region 353 is increased by at least 0.1° C. The light waves 330 can have a pattern that corresponds to incoming information at least in terms of frequency or amplitude, and the temperature increase in the inner ear region 353 also corresponds to incoming information.

In some embodiments, the sound driver 311 and light emitters (312, 313) are further configured such that the emitted light 330 reaches the tympanic membrane 352 substantially simultaneously with emitted sound waves 320. For example, emitted light waves 330 reach the tympanic membrane 352 within 0.01 msec, 0.1 msec, or 0.5 msec before or after the emitted sound waves 320 reach the tympanic membrane 352. In other embodiments, the sound driver 311 and light emitters (312, 313) are further configured such that the emitted light 330 reaches the inner ear region 353 substantially simultaneously with emitted sound waves 320. For example, emitted light waves 330 reach the inner ear region 353 within 0.01 msec, 0.1 msec, or 0.5 msec before or after the emitted sound waves 320 reach the inner ear region 353.

Figure 4:
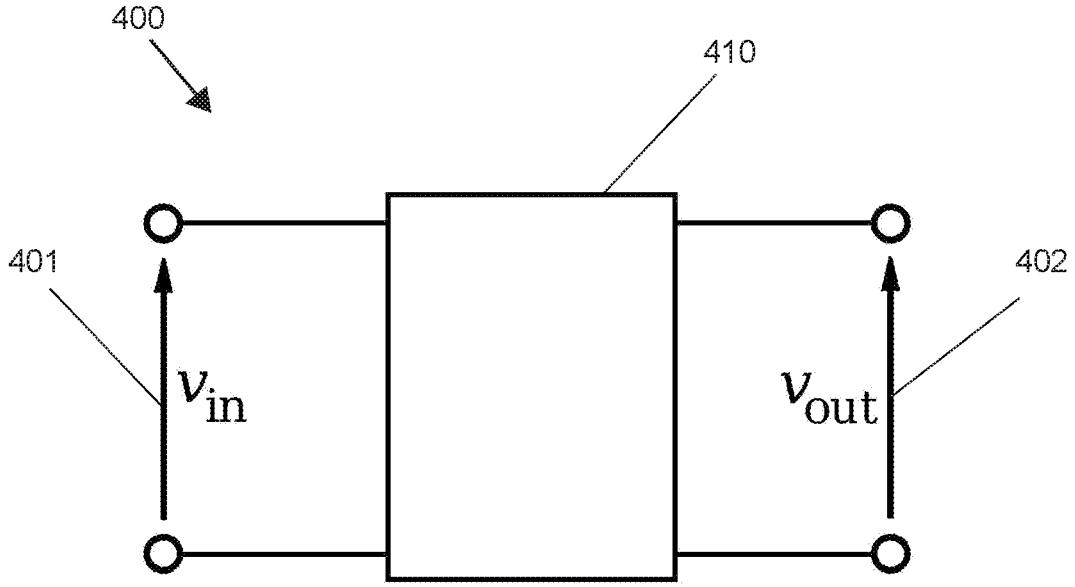
FIG. 4 shows an electrical circuitry having a low band pass filter.

FIG. 4 shows an electrical circuitry 400 having a low band pass filter 410. The low band pass filter 410 only passes low frequency signals of the incoming information 401, such that the output information 402 only has low frequency signals that can be used to produce the pattern of light waves. For example, the circuitry 400 can be used to generate a pattern comprising pulses with varying frequencies preferably below 50 Hz, or more preferably, below 32 Hz.

Figure 5:
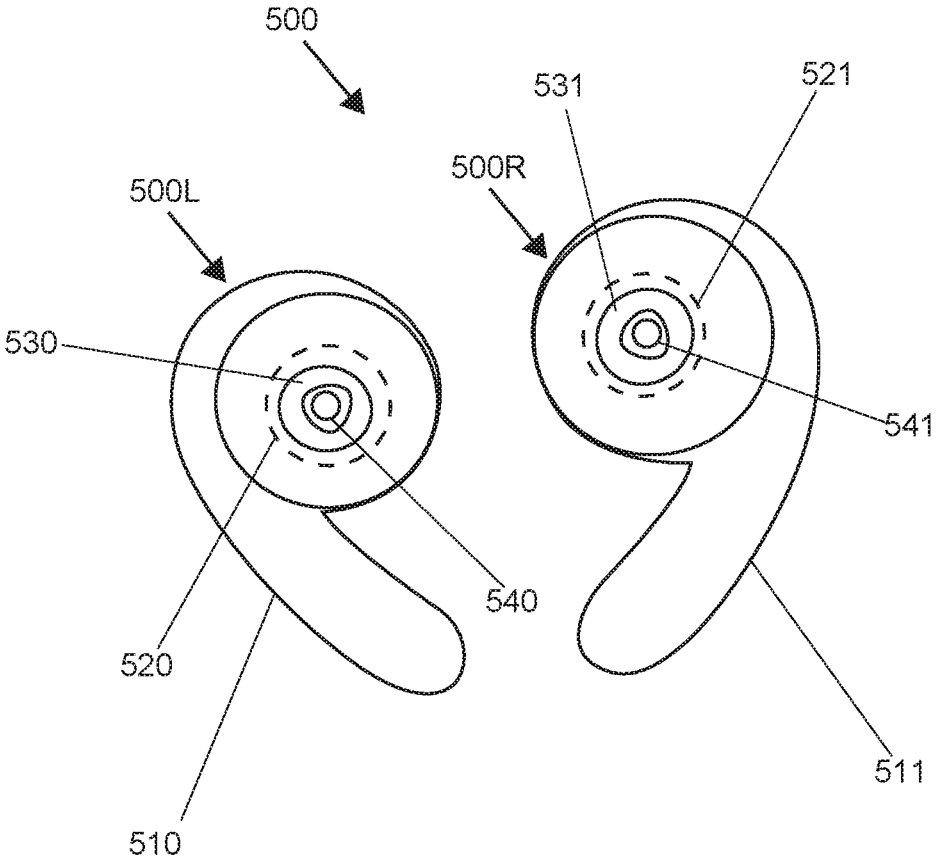
FIG. 5 shows a pair of another embodiment of wearable apparatuses.

FIG. 5 shows a pair of wearable apparatuses 500L and 500R for creating sensation in the left ear and right ear, respectively. The wearable apparatus 500L has a housing 510 with an opening 530, a sound driver 520, and a light emitter 540. The wearable apparatus 500R has a housing 511 with an opening 531, a sound driver 521, and a light emitter 541. It is contemplated that wearable apparatuses 500L and 500R can receive incoming information wirelessly, e.g., by Bluetooth® or infrared signal.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A wearable apparatus for providing a sensation to an ear of a user, the ear having an ear canal, a tympanic membrane, and an inner ear region, the apparatus comprising:

a sound driver configured to emit sound waves in correspondence to incoming information; and a first light emitter configured to emit light waves using a pattern of pulses having a frequency between 0.1 Hz and 50 Hz;

wherein the apparatus is configured such that at least some of the emitted light waves pass through the tympanic membrane to the inner ear region.

2. The apparatus of claim 1, wherein the sound driver and light emitter are further configured such that the emitted light reaches the inner ear region within 0.1 msec before or after the emitted sound waves.

3. The apparatus of claim 1, wherein there is no artificial barrier between the light emitter and the tympanic membrane.

4. The apparatus of claim 1, wherein neither the sound driver nor the light emitter blocks more than 50% of ambient audible sound from passing through the ear canal to the tympanic membrane.

5. The apparatus of claim 1, further comprising a second light emitter configured to emit light waves that are complementary to, and between 175 and 185 degrees out of phase with, the light waves from the first light emitter.

6. The apparatus of claim 1, further comprising a second light emitter configured to emit light waves that combine with the light waves from the first light emitter to produce scalar waves.

7. The apparatus of claim 1, further comprising a low band pass filter that passes low frequency signals of the incoming information, and a circuitry configured to use the low frequency signals to produce the pattern.

8. The apparatus of claim 7, wherein the frequency of the pattern is between 16 Hz and 32 Hz.

9. The apparatus of claim 1, wherein further comprising a circuitry configured to vary the pattern corresponding to varying amplitudes of the incoming information.

10. The apparatus of claim 1, wherein further comprising a circuitry configured to vary the pattern corresponding to varying frequencies of the incoming information.

11. The apparatus of claim 1, wherein the first light emitter is configured to emit the light waves at a wavelength of between 645 nm and 655 nm.

* * * * *